United States Patent [19]

Chalmers et al.

[11] 4,193,238

[45] Mar. 18, 1980

[54] WINDOW CASING COVER

[75] Inventors: Alexander A. Chalmers, Warren; J. Lynn Gailey, Newton Falls; Carl A. Wollam, Cortland, all of Ohio

[73] Assignee: Alcan Aluminum Corporation, Cleveland, Ohio

[21] Appl. No.: 910,063

[22] Filed: May 26, 1978

[51] Int. Cl.[2] ..... E06B 1/04; E04F 19/02

[52] U.S. Cl. ..... 52/211; 52/105; 52/656; 52/718

[58] Field of Search ..... 52/105, 99, 100, 211, 52/212, 209, 656, 717, 718

[56] References Cited

U.S. PATENT DOCUMENTS

| | | | |
|---|---|---|---|
| 279,425 | 6/1863 | Parmele | 52/97 |
| 463,830 | 11/1891 | Gibson | 52/718 |
| 899,259 | 9/1908 | Ohnstrand | 52/212 |
| 1,150,790 | 8/1915 | Swanson | 52/211 |
| 1,229,765 | 6/1917 | Lehman | 52/718 X |
| 1,241,243 | 9/1917 | Otte | 52/211 |
| 1,308,276 | 7/1919 | Connell | 52/212 |
| 2,473,400 | 6/1949 | Waara | 52/718 X |
| 2,734,602 | 2/1956 | Dawson | 52/97 |
| 2,942,703 | 6/1960 | Nelsson | 52/717 |
| 3,098,267 | 7/1963 | Dean et al. | 52/78 |
| 3,139,703 | 7/1964 | Hilt | 52/211 X |
| 3,228,159 | 1/1966 | Vecchiarelli et al. | 52/222 |
| 3,678,641 | 7/1972 | Englund et al. | 52/484 |

FOREIGN PATENT DOCUMENTS 1923560 11/1970 Fed. Rep. of Germany ..... 52/105

*Primary Examiner*—Alfred C. Perham

*Attorney, Agent, or Firm*—Cooper, Dunham, Clark, Griffin & Moran

[57] ABSTRACT

A snap-on cover for window casings including elongated metal or like resiliently deformable case molding members mountable on brackets secured at spaced locations along a window casing. The case molding members snap onto the brackets; each bracket has a base, a pair of spaced, aligned seats projecting outwardly therefrom for engagement by the edges of a molding member, and a leg also projecting outwardly from the base for retaining the molding member against inward displacement. A screw extending inwardly through an elongated opening in the base and surrounded by a helical spring under compression between the screw head and the base secures the bracket to the subjacent casing or other structure in a manner enabling self-aligning positional adjustment of the bracket in several directions when a molding member is mounted thereon. The case molding members may be provided as overlapping sections, to accommodate a range of window dimensions. A complete casing cover kit may also include L-section trim members for covering the edges of a window casing inwardly of the margins of the molding members, and overlapping covers for a window sill.

24 Claims, 15 Drawing Figures

Fig. 5.
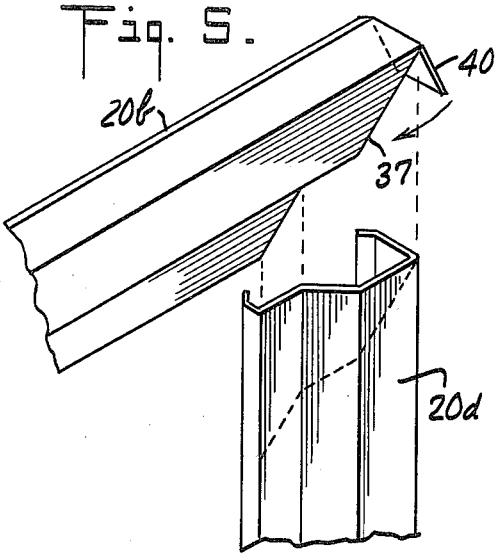
Fig. 2.
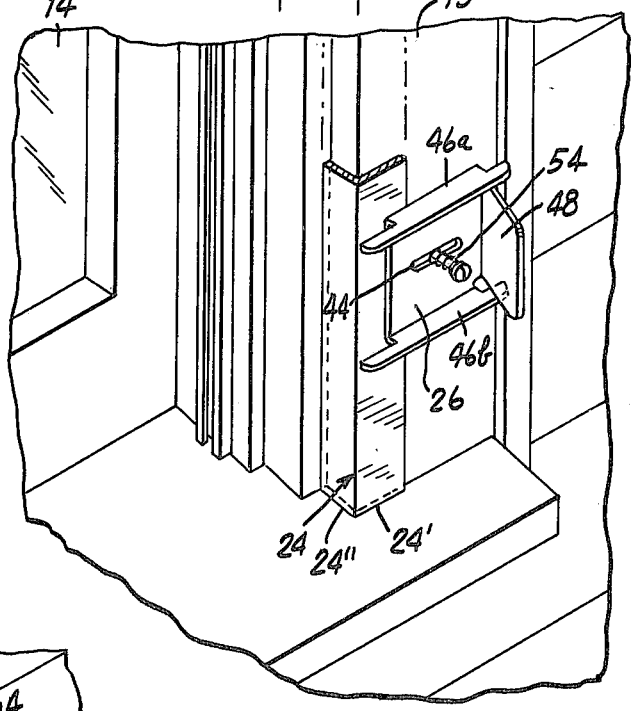
Fig. 3.
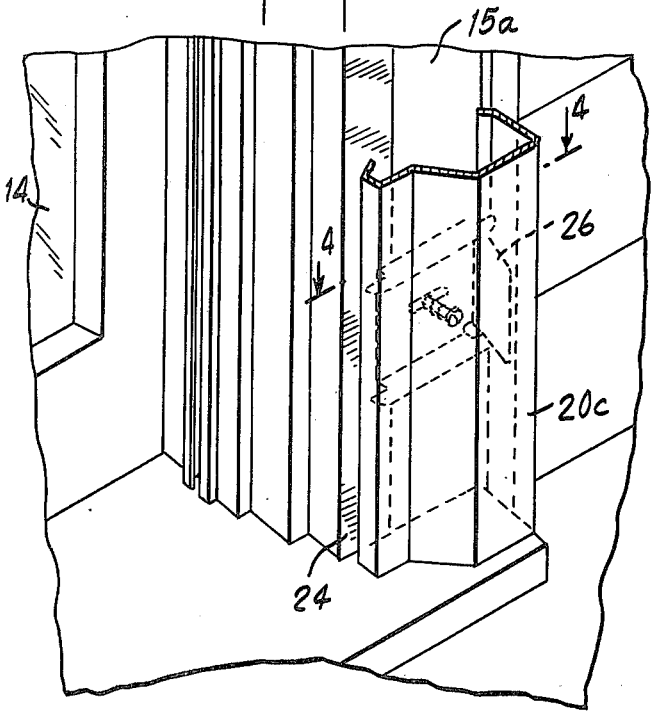
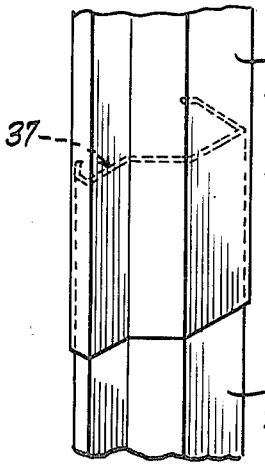
Fig. 6.
Fig. 4.
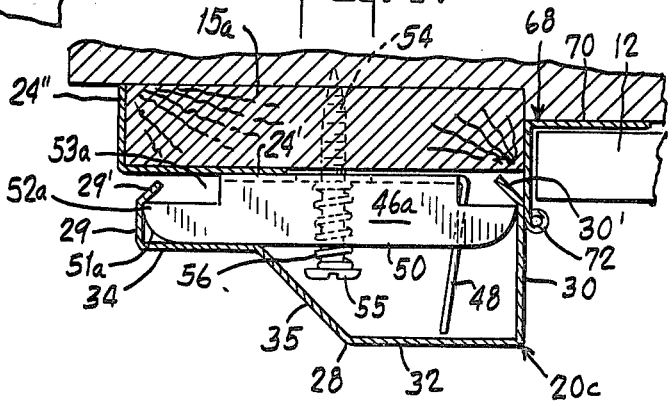
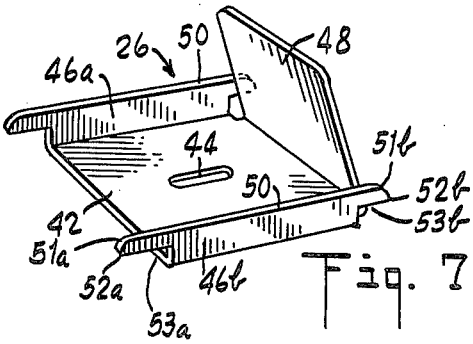
Fig. 7.

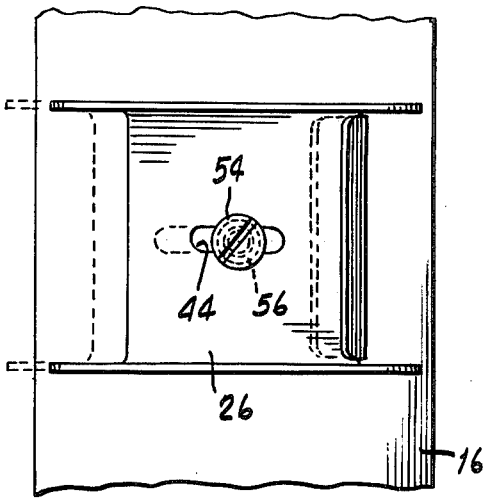
Fig. 12.
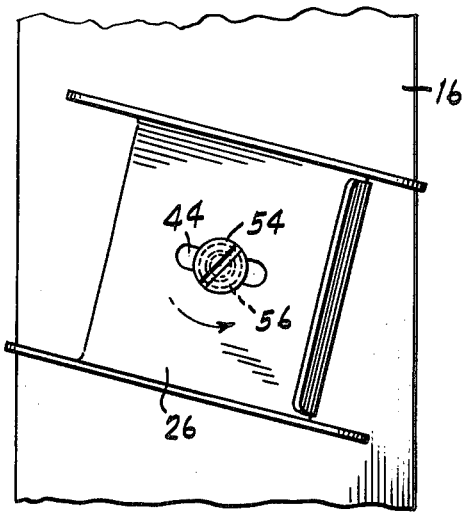
Fig. 13.
Fig. 14A.
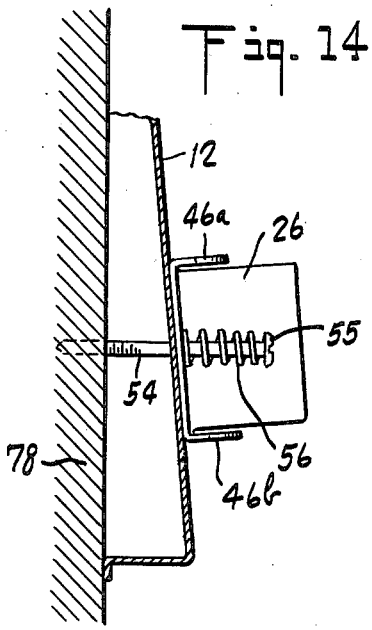
Fig. 14B.
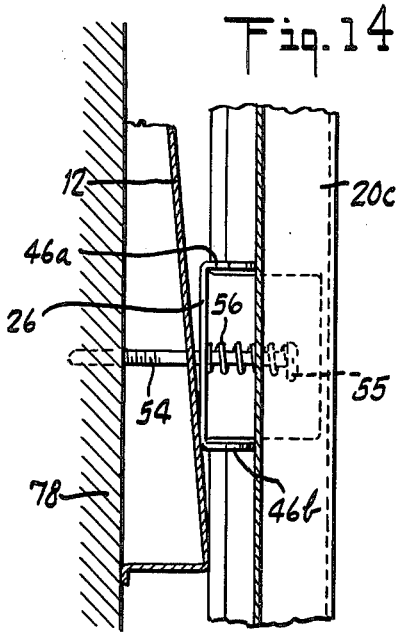

WINDOW CASING COVER

BACKGROUND OF THE INVENTION

This invention relates to covers for window casings, and more particularly to window casing covers for use in conjunction with metal siding or the like on exterior walls of buildings.

In conventional housing construction, window openings in a wall are provided with casings, which are typically wooden trim or molding elements protruding to some extent from the exterior facing of the wall. The configurations and dimensions of these casings vary widely. When metal or plastic siding or the like is used to refurbish a building wall, i.e. replacing or applied over existing clapboards, shingles or other facing material, it is preferable not to leave the existing window casings exposed, because the need for relatively frequent painting or other care of such casings prevents full realization of the benefit of the newly installed siding material in reducing exterior building maintenance. Moreover, the existing window casings are often aesthetically incompatible with such siding materials; for example, the added thickness of metal siding installed over another (e.g. shingle or clapboard) facing may so alter the visual relationship of the casings to the wall surface as to produce an incongruous appearance. Sometimes window casings are "jumped" by extending the siding panels over them, thereby to avoid the aforementioned maintenance problems, but this is not always feasible or convenient (especially where strongly protruding casings are encountered), and the resultant concealment of the casings detracts from the appearance of the siding-clad wall, which is generally intended to resemble a traditional house wall with frame windows as closely as possible.

Accordingly, it would be desirable to provide a metal or like trim system, usable with metal or other siding to cover existing window casings (or, in new construction, as a substitute for conventional window casings), that would simulate conventional window casings in appearance while affording the same durability and freedom from maintenance as the siding panels themselves.

It would be particularly desirable to provide such a trim system capable of installation by relatively untrained personnel without special and complex equipment, or even capable of "do-it-yourself" installation by homeowners. This installation, desirably, should be usable either in conjunction with installation of siding panels or as an improvement for previously applied siding, e.g. to improve the appearance of walls having jumped casings.

Heretofore, however, the wide diversity of window sizes, casing shapes and dimensions, and other conditions encountered where metal or like siding is used has presented substantial problems in that such trim systems (if employed at all) have had to be more or less specially tailored or custom-fit for each specific situation; and their installation has been relatively difficult, requiring highly skilled installers. Proper alignment of trim components has presented particular difficulty, most especially when the subjacent casing or other support surface is warped, sloping, irregular, or not square.

SUMMARY OF THE INVENTION

The present invention broadly contemplates the provision of a windown casing cover comprising a plurality of case molding members for coverng a window casing and a plurality of brackets for mounting the case molding members in proximate relation to a window casing to be covered, wherein each of the case molding members is a resiliently deformable channel section opening inwardly and having a central web and opposed longitudinal flanges bent toward each other, and wherein each of the brackets has a base portion mountable on supporting structure (e.g. a window casing) and at least one generally C-shaped seat portion projecting outwardly from the base and grippable between the opposed flanges of one of the case molding members for holding it on a window casing, the case molding members and the brackets being mutually dimensioned for snap-on engagement of the flanges with the seats. It will be understood that terms such as "inner" or "inwardly" and "outer" or "outwardly" herein refer to directions respectively toward and away from the wall on which a window casing cover is mounted. For convenience, the term "casing" will sometimes be used herein to refer generically to the supporting structure surrounding a window, on which a casing cover embodying the invention is mounted, whether such structure is (for example) a conventional casing, portions of an array of siding panels disposed in jumped relation to a casing, or the wall itself (if there is no casing).

As a particular feature of the invention, in an important aspect thereof, each of the brackets has a pair of seat portions disposed in spaced parallel relation to each other so as to be simultaneously gripped by the flanges of a case molding member mounted on the bracket, i.e. at spaced points along the flanges, it being understood that each seat is so oriented that its long dimension is perpendicular to the long dimension of a case molding member mounted thereon; and fastening means are provided for securing each bracket to a casing while permitting self-aligning movement of the bracket relative to the casing upon engagement of the flanges of a case molding member with the bracket seat portions after the bracket is secured to the casing. The self-aligning bracket motion permitted by the fastening means includes translational, rotational, and in-and-out movement of the bracket relative to the casing. To this end, further in accordance with the invention, the base portion of the bracket may have an elongated slot and its long dimension substantially parallel to the long dimensions of the bracket seat portions, and the fastening means may include a fastening element extending through the slot into a subjacent casing, and means, acting between the fastening element and the bracket base portion, for resiliently biasing the base portion into engagement with the subjacent casing. Thus, in a preferred embodiment, each bracket is mounted on a window casing or other supporting structure by means of a fastening element (such as a screw) having a head and a shank which projects through the slot of the base portion into the subjacent casing or other supporting structure, with the head spaced outwardly from the base portion. A helical spring surrounds the shank under compression between the head and the bracket base portion, to urge the base portion against the casing, for holding the bracket in a stable position.

This combination of the paired seats and base portion slot of the bracket with the fastening element and the spring enables the bracket to move in any one or more of several directions (relative to the casing or other supporting structure on which it is mounted), and thereby to be effectively self-aligning upon engagement of a case molding member with the bracket seats. Thus, the elongated slot accommodates translational movement of the bracket, relative to the fastening element and supporting structure, in a direction transverse to the long dimension of the case molding member mounted on the bracket. The spring permits the bracket to undergo this translational displacement, and also to undergo pivotal movement about the axis of the fastening element shank. In addition, the spring enables the bracket to move outwardly relative to the supporting structure (rather than being fixed with its base held flat against the supporting structure), as is especially important when the window casing cover is mounted over a sloping or irregular surface such as a jumped casing wherein the brackets overlie siding panel surfaces which are oblique to the long dimensions of the case molding members. That is to say, engagement of the paired seats of a bracket with the flanges of a case molding member inherently aligns the bracket properly in relation to the member (i.e. with the long dimensions of the seats perpendicular to the long dimension of the case molding member, and with the base portion surface lying in a plane parallel to the long dimension of the case molding member), regardless of the origentation of the bracket when it is initially mounted, the spring and slot serving to accommodate this self-aligning movement of the bracket. Consequently, these features of the invention cooperatively enable the window casing cover to be installed without modification in any of a wide variety of different situations (e.g. on casings that are not square, and on irregular surfaces such as jumped casings), and also avoid the need for special skill or care in initially positioning the brackets, so that the cover can be installed by homeowners or other relatively untrained personnel using only ordinary household tools.

Very advantageously, the case molding members are formed with a stepped profile; i.e. one side of the web of each member is offset outwardly with respect to the other side of the web, the width (dimension transverse to the web) of the flanges on the outwardly offset side of the web being correspondingly greater than the width of the flange on the other side of the web. This configuration enhances the resemblance of the casing cover to a conventional wooden casing and also ensures that the casing cover will project prominently outward beyond a surrounding, metal-sliding-clad wall surface, as desired for reasons of appearance. The case molding members having the described stepped profile are usually or preferably oriented (when mounted around a window) with the outwardly offset sides of the webs away from the window.

As another particular feature of the invention, the mounting brackets used with the stepped-profile case molding members are each provided with a leg portion, projecting outwardly from the base portion beyond the seat portion, for engaging the outwardly offset web portion of a case molding member mounted on the bracket, so as to prevent inward displacement of the case molding member especially where (owing to the shape or dimensions of the window casing being covered) the wider flange of the case molding member does not abut any subjacent wall or casing. The seat portion of the bracket itself projects far enough outwardly to engage (and thus similarly to support against inward displacement) the non-offset side of the case molding member web. Preferably, with a bracket having a spaced pair of such seat portions, simultaneously grippable between the flanges of the same case molding member, the leg portion is disposed between the two seat portions. This bracket structure affords a high degree of positional stability for the case molding members together with ease of installation, and as already explained, enables use of the same casing cover (without modification) on any of a variety of types and dimensions of casings or allows it to be mounted directly on the surface of siding where the casings have been jumped. Each bracket may be a unitary element formed by cutting and bending a metal plate.

Still further in accordance with the invention, the casing cover may include a first pair of case molding members for covering the top of a rectangular window casing and second and third pairs of case molding members for respectively covering the two sides of the casing, with one of the members of each pair overlapping the other so that, without cutting, the same casing cover can be adjusted to conform to a substantial range of window dimensions. It is found that by appropriate selection of the lengths of the individual case molding members, only a small number of casing cover kits having this overlapping feature is needed to accommodate a very wide range of window sizes; hence a manufacturer can readily produce a standard line of kits that will meet most commonly encountered dimensional requirements.

In such a kit, the outer corners of the top pair of case molding members may be cut at an oblique angle such that when the top pair of members receive overlappingly the upper ones of the top side pairs of case molding members at these corners, the joints at the top corners appear to be mitered, even if it is necessary to deviate from the true square corners, without requiring any cutting operation by the user. Each outer corner of the top pair of members may be provided with a tab that is foldable over the upper side case molding member received within such a corner, to aid in holding the members together in assembled relation while inhibiting entrance of water at the corner.

A complete casing cover kit in accordance with the invention also includes angle (L-section) members mountable along the edges of a window casing inwardly of the case molding members, for covering these exposed edges, and a pair of sill covers respectively shaped for fitting over right and left portions of a window sill, one of the sill covers overlapping the other to accommodate a range of sill lengths. The inner portion of each sill cover may be provided with plural score lines to facilitate cutting of the sill cover to conform to the particular configuration of the sill on which it is mounted. This cutting operation, aided by the score lines, is the only cutting step ordinarily required for installation of a window casing cover with the kit of the invention.

The casing molding members, angle members and sill covers may be formed of sheet metal and may be prepainted or otherwise protectively coated to provide durability (without need for repainting or other maintenance) equivalent to that of metal siding. The cover of the invention provides substantially full coverage of a conventional window casing, thus overcoming the maintenance problems that result when a conventional casing is left exposed, and is compatible in design with siding materials such as metal siding, simulating as desired the appearance of a conventional casing. It may readily be installed over any of a wide variety of conventional casings, or over a jumped casing (to improve the appearance of a previous metal or like siding installation), or directly on the sheathing or studs around a window of a new building being faced with metal or other siding; and once in place it is permanent and secure, although the snap-on feature enables ready replacement of one or more case molding members if necessary.

Further features and advantages of the invention will be apparent from the detailed description hereinbelow set forth, together with the accompanying drawings.

BRIEF DESCRIPTION OF THE DRAWINGS

FIG. 2 is an enlarged fragmentary perspective view illustrating one of the mounting brackets of the cover of FIG. 1, fastened on a flat board casing to be covered;

FIG. 3 is a view similar to FIG. 2, showing a case molding member mounted on the bracket;

FIG. 4 is a further enlarged sectional view taken along the line 4—4 of FIG. 3;

FIG. 5 is a fragmentary exploded perspective view illustrating details of the assembly at a top corner of the casing cover of FIG. 1;

FIG. 6 is a fragmentary perspective view showing the telescoping interengagement of two case molding members on one side of the casing cover of FIG. 1;

FIG. 7 is a perspective view of one of the brackets of the FIG. 1 casing cover;

FIGS. 12 and 13 are front elevational views of one of the brackets of the FIG. 1 casing cover, as mounted on a flat board casing, respectively illustrating two modes of self-aligning motion of the bracket permitted by the mounting arrangement; and FIGS. 14A and 14B are sectional elevational views taken along the line 14—14 of FIG. 11, and respectively showing the position of a bracket before and after a case molding member is snap-fitted thereon, to illustrate the self-aligning motion of the bracket when used in a jumped casing installation.

DETAILED DESCRIPTION

Figure 1:
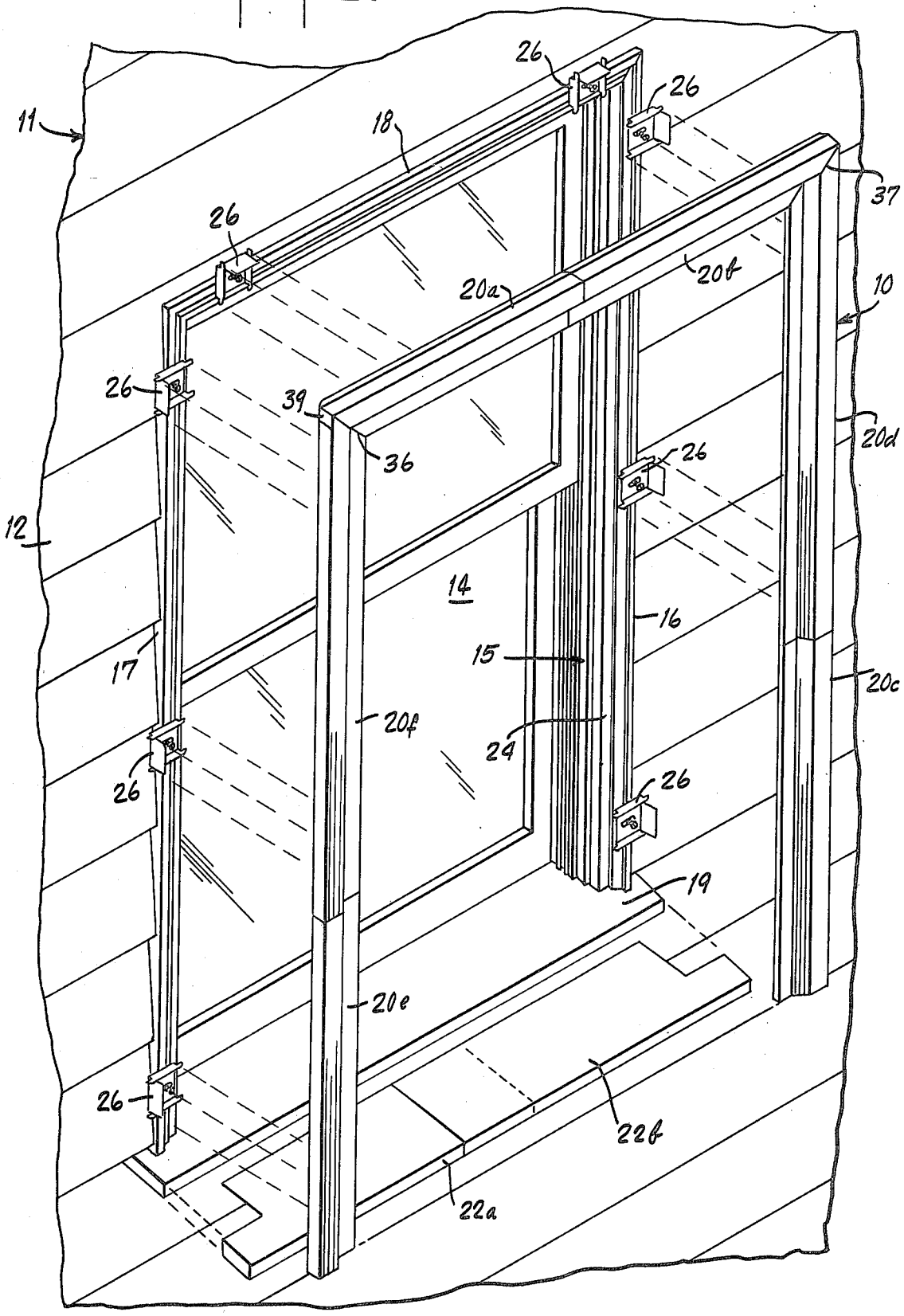
FIG. 1 is a partly exploded perspective view of a window casing cover embodying the present invention in a particular form, associated with a conventional wooden window casing on a house wall.

Referring to the drawings, the invention is illustrated in FIG. 1 as embodied in a window casing cover system 10 for mounting on a building wall 11 faced with conventional horizontal metal siding panels 12. As shown, a conventional double-hung window 14 is mounted in the wall 11 and surrounded with a conventional rectangular wooden window casing 15 having vertical side portions 16 and 17, horizontal top portion 18, and a sill 19 all designed to project outwardly of the facing of wall 11. The casing cover system 10, as hereinafter explained, serves to cover the casing 15 for aesthetic and protective reasons.

Specifically, the cover system 10 comprises a first pair of case molding members, respectively designated 20*a* and 20*b*, for covering the top portion 18 of the casing; a second pair of these molding members 20*c*, 20*d*, and a third pair of case molding members 20*e*, 20*f* for respectively covering the two side portions 16 and 17 of the casing; a pair of sill covers 22*a* and 22*b* for covering the sill 19; angle members 24 for covering the edges of the top and side portions of the casing 15; and a plurality of brackets 26 for mounting the case molding members on the casing 15. The case molding members 20*a–f*, sill covers 22*a* and 22*b*, and angle members 24 are all fabricated of sheet metal (e.g. aluminum or an alloy thereof) and are produced by generally conventional forming, bending and cutting techniques which will be readily apparent to those skilled in the art from the following description of their structure and configuration. These elements are prepainted or otherwise protectively coated on their external surfaces in the same manner as the siding panels 12; thus, when mounted on a window casing, they afford durability and freedom from maintenance comparable to that of the siding panels themselves.

As best seen in FIGS. 3–5, each of the case molding members 20*a–f* is a channel section having a central web 28 and first and second longitudinal flanges 29 and 30 projecting inwardly from the web along opposite sides thereof. The inner margins of both flanges 29 and 30 are bent toward each other as indicated at 29′ and 30′ for gripping a bracket 26, as hereinafter further explained.

Web 28 is formed with a stepped profile, one side 32 of the web being offset outwardly with respect to the other side 34 of the web, while the central portion 35 of the web slopes outwardly from portion 34 to portion 32; flange 30, on the outwardly offset side of the web, is wider than the opposite flange 29 by an amount corresponding to the depth of offset such that the inner edges of the two flanges 29 and 30 lie in a common plane parallel to the planes of the offset and non-offset web portions 32 and 34. The described stepped profile enhances the resemblance of the case molding members to a conventional window casing and insures that they will project outwardly as desired from the metal siding with which the casing cover is used, i.e. even if the siding is installed over a pre-existing layer of shingles or clapboard and projects outwardly beyond the original casing.

In the embodiment illustrated in FIGS. 1–6, one of the case molding members of each pair (20*a, b;* 20*c, d;* 20*e, f*) overlaps the other member of the pair so that the overall dimensions of the casing cover can be varied to conform to the dimensions of the particular window casing being covered. Thus, as indicated at 37 in FIG. 6, the lower one 20*c* of the pair of case molding members which covers the side 16 of casing 15 received in (i.e. overlapped by) the upper member 20*d*. Similarly, the lower member 20*e* overlapped by the upper member 20*f* of the pair of case molding members covering the casing side 17, and one member of the top pair of case molding members 20*a*, 20*b* overlaps the other member of that pair. Although one of the two members of each of the aforementioned pairs may be made slightly larger than the other in cross-sectional dimensions to provide a telescoping interfit, this is not necessary; owing to the open profile configuration of the members, both members of each pair may conveniently be identical in cross-sectional dimensions, each being sufficiently resiliently deformable to overlap, or to be received within, the other.

The opposite corners of the top pair of case molding members 20*a*, 20*b* (i.e. the left-hand corner 36 of member 20*a* and the right-hand corner 37 of member 20*b*, as seen in FIG. 1) are cut at an oblique angle, and receive and overlap the upper ends of the upper side case molding members 20*d* and 20*f* respectively (FIG. 5), to provide the appearance of mitered corners in the assembled casing cover. In addition, these corners 36 and 37 of the top pair of case molding members respectively have laterally projecting tabs 39 and 40 which are bent downwardly over the upper side case molding members 20*d* and 20*f*, respectively, when the casing cover is installed, to aid in holding the assembled case molding members securely together as well as to inhibit entrance of moisture at the joints between the side and top members.

Each of the brackets 26 is a unitary, integral element formed of sheet metal and includes a flat, square base portion 42 having a centrally disposed slot-shaped opening 44 therein, a pair of generally C-shaped seat portions 46*a* and 46*b* respectively projecting outwardly from opposite ends of the base portion 42 so as to be disposed in aligned, parallel spaced relation to each other, and a leg portion 48 projecting outwardly from one side of the base portion, between the two seat portions, for a distance greater than the extent of outward projection of the seat portions. This bracket is formed by cutting a sheet metal blank, punching out the opening 44, and bending the seat portions and the leg portion in a common direction relative to the plane of the base portion. Each seat portion has a straight outer edge 50 which curves inwardly at each end, as indicated at 51*a* and 51*b* (FIG. 7), to terminate in a sharp apex 52*a* or 52*b*; the two apexes 52*a* and 52*b* project somewhat beyond the base portion 42 on opposite sides thereof, respectively, and each end of the seat portion is cut away inwardly of the apex as indicated at 53*a* and 53*b*. The long dimensions of the seat portions are parallel to the long axis of the opening 44.

The bracket seat portions 46*a* and 46*b* and the case molding members 20*a–f* are mutually so dimensioned that any of the case molding members can be snap-fitted over the two seat portions of a bracket (as shown, for example, in FIG. 4) with the bent inner edges 29′ and 30′ of the case molding member flanges respectively accommodated by the cut-away areas of the seat portions, and with the straight outer edges 50 of the seat portions bearing against the inner surface of the non-offset portion 34 of the case molding member web, while the leg portion 48 of the bracket is dimensioned to bear against the inner surface of the offset portion 32 of the case molding member web when the case molding member is mounted on the bracket seat portions. More particularly, the distance between the inner surfaces of the case molding member flanges 29 and 30 (i.e. when the member is in unstressed condition) is just slightly less than the length of each bracket seat portion from apex 52*a* to apex 52*b*, the distance between the bent inner edges 29′ and 30′ of these flanges being substantially less than the seat portion length; the extent of outward projection of each seat portion is at least equal to the width of the flange 29 on the non-offset side of the case molding member, and the bracket leg portion 48 projects farther outward than the seat portions by an amount equal to the extent of offset of web portion 32, viz. an amount equal to the difference between the widths of the flanges 29 and 30.

The case molding members 20*a–f* are made of sufficiently light-gauge sheet metal to be resiliently deformable. To mount one of the case molding members on a bracket 26 secured to a window casing, the case molding member is initially positioned outwardly of the bracket with its channel opening toward the bracket and its long dimension perpendicular to the long dimension of the two seat portions 46*a* and 46*b*; the case molding member is then manually pressed inwardly over the bracket, causing the flanges 29 and 30 to spread apart as their edges 29′ and 30′ ride along the curved ends 51*a* and 51*b* of the seat portion edges, until the flange edges pass the apexes 52*a* and 52*b* of the seat portions. Thereupon, the case molding member flanges snap resiliently into place, simultaneously gripping the two aligned seat portions of the bracket, being secured against dislodgment by their gripping engagement with the seat portion apexes and by the disposition of their bent edges inwardly of the apexes, although the case molding members can be pulled off the brackets by application of sufficient manual force if it is necessary to repair or replace them.

In the installation of the casing cover on a window casing, a plurality of the brackets 26 are mounted in spaced relation to each other along both sides and the top of the casing. Referring to installation on a flat board casing as shown in FIGS. 2–4, wherein the sides and top of the casing are constituted of flat boards 15*a* having squared edges, each bracket is positioned with the inner surface of its base portion 42 lying flat against a casing board and with the long dimensions of its seat portions oriented transversely of the casing board. The bracket is secured to the casing by means of a headed screw 54 which extends through the bracket opening 44 into the subjacent casing board; as shown in FIGS. 2–4, the head 55 of the screw is not tightened against the base portion but is spaced outwardly therefrom, and a helical spring 56 surrounding the screw under compression between the screw head and the base portion urges the base portion against the casing board to hold the bracket in place. This fastening arrangement, together with the elongation of the opening 44 in the bracket base portion, permits limited movement of the bracket in any of several directions, as hereinafter further explained. Thus, alignment of the brackets spaced along either side, or along the top, of the casing is not highly critical, i.e. because they can shift into proper alignment when the case molding members are snapped onto them; and since the precise amount of spacing between adjacent brackets is also not critical, mounting of the brackets is relatively easy so as to be readily accomplished by an untrained user having no special tools. As indicated in FIG. 1, three brackets spaced along each side of a window casing and two spaced along the top are ordinarily sufficient for securing all of the case molding members, owing to the high degree of positional stability cooperatively afforded by the paired seat portions and the leg portion of each bracket.

Once the brackets have been mounted on the casing sides and top, the case molding members are snapped into place in the manner already described. As shown, these members are installed with their outwardly offset sides (i.e. their greater extent of outward projection) oriented away from the window they surround, in conformity with traditional window casing design; the brackets are accordingly mounted with their leg portions 48 disposed on the side of the casing away from the window. The extent of overlap of each pair of case molding members is selected to fit the window casing dimensions. Installation of the case molding members is completed by folding down the tabs 39 and 40.

A complete casing cover system in accordance with the invention also includes the aforementioned angle members 24 and sill covers 22a and 22b. The angle members, precut to appropriate lengths, are mounted on the edges of the sides and top of the window casing adjacent the window, before the brackets (which, as best seen in FIG. 2, partially overlie these angle members) are installed, to provide coverage for the casing edges inwardly of the case molding members; each of the angle members has a long leg 24' which overlies the outwardly facing surface of the casing, and a shorter leg 24" (with a slightly bent inner edge, FIG. 10) which overlies the laterally facing surface of the casing. The leg 24' is sufficiently long to ensure coverage of the outwardly facing surface of the casing even in the event that the case molding members have to be installed in nonsquare relation to the inner edge of the casing. Thereby, the angle members 24 contribute to the compatibility of the casing cover system with diverse circumstances.

Figure 8:
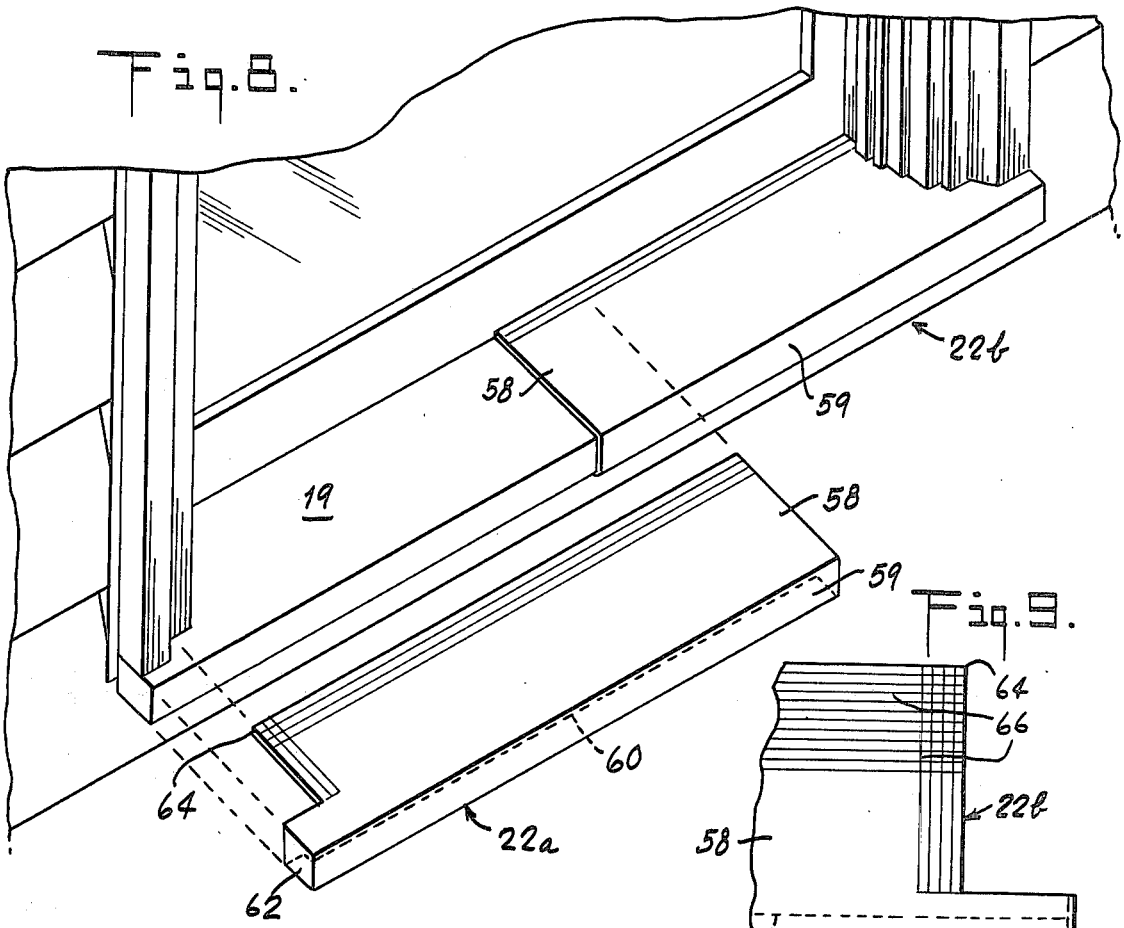
FIG. 8 is a perspective view, partially exploded, of the sill covers of the FIG. 1 casing cover.
Figure 9:
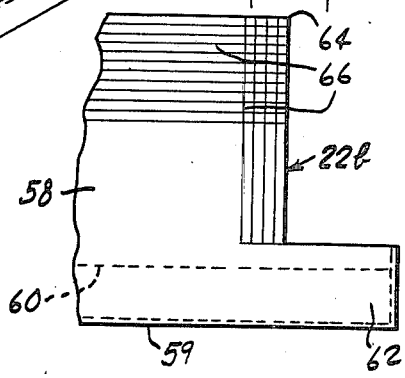
FIG. 9 is a fragmentary plan view of one of the sill covers.

The two sill covers (one overlapping the other) are mounted on the sill in covering relation thereto. Each sill cover has a broad, flat top portion 58 (FIG. 8) for covering the top of the sill, and is bent downwardly at the front as indicated at 59 to cover the front edge of the sill, its lower edge 60 being bent rearwardly to underlie the sill edge. At one end, each sill cover has a rearwardly opening, boxlike lateral projection 62 for receiving an end of the sill. The side corner 64 of each sill cover top portion 58 is cross-hatched with two sets of parallel score lines 66 (FIG. 9) respectively parallel and perpendicular to the rear edge of the sill cover, to facilitate cutting of the sill cover to fit the configuration of a particular window casing being covered; this is the only cutting operation ordinarily required in installation of the present casing cover system.

Referring further to FIG. 4, the ends of the metal siding panels 12 adjacent the window casing boards 15a there shown are covered, as is conventional, by an angle member 68 having one leg 70 lying flat against and secured to the subjacent wall structure, and a second, beaded leg 72 projecting outwardly of the panels between the panel ends and the window casing. This leg 72 serves as a convenient stop for positioning the brackets 26. It will be noted that the panels 12 themselves project outwardly of the casing boards 15a, contrary to the desired relationship between panels and casing; but the case molding members project substantially outwardly of the panels, and thus satisfactorily simulate the desired appearance of a window casing protruding in relation to the adjacent siding.

Figure 10:
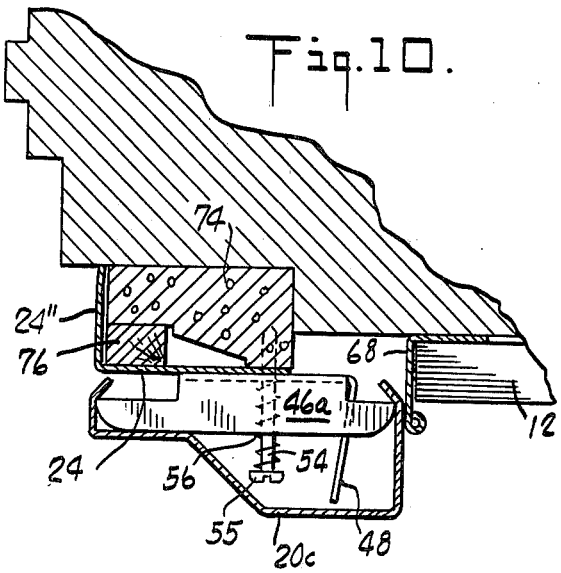
FIG. 10 is a view similar to FIG. 4, illustrating installation of the casing cover on a so-called brick mold window casing.

The described casing cover may be used, without any modification, in a wide variety of different situations. For example, as shown in FIG. 10, the system of FIG. 1 may be used to cover a brick mold window casing 74, which is a narrow casing having a stepped profile. Since the brick mold casing is considerably narrower than the case molding members of the present casing cover, the ends of the siding panels 12 and their associated angle members 68 are spaced from the casing 74 to accommodate the width of the case molding members. The inner edge of the casing 74 is covered with the angle members 24, with wooden shims 76 interposed between the casing and the angle members 24 for support. The brackets 26 are mounted on the casing 74 outwardly of the angle members 24, in the manner already described, and the case molding members (member 20c being illustrated) are snapped onto the brackets. In this situation, the brackets 20 overhang the casing on the side away from the window, and as a result there is no subjacent support surface near the inner edge of the case molding member flange 30; nevertheless, the bracket leg 48 restrains the case molding member against inward displacement on the side adjacent the flange 30.

Figure 11:
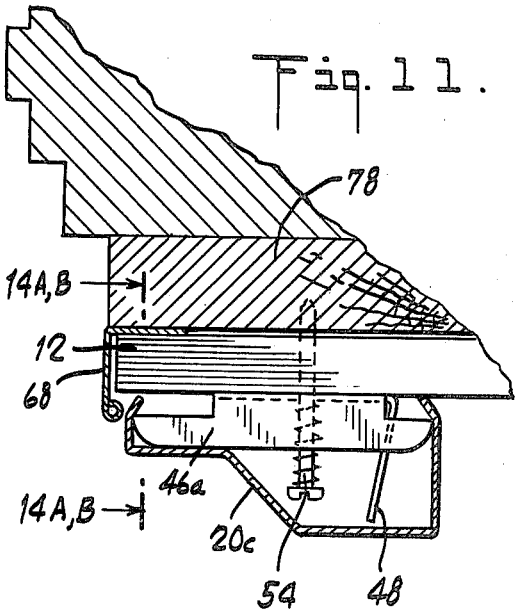
FIG. 11 is another view similar to FIG. 4, illustrating installation of the casing cover on a jumped window casing.

The same casing cover system of the invention may also be used on a jumped casing, as shown in FIG. 11, which illustrates a flat board window casing 78 that has previously been covered by the ends of metal siding panels 12 such that the angle member 68 (which covers the panel ends) is disposed on the window side of the original casing. In this case, the angle members 24 are not used; the brackets 26 are mounted directly over the siding panel end portions, with the screws 54 extending through the panels into the subjacent casing 78, and the case molding members are snapped onto the brackets, providing the appearance of a conventional window casing.

The manner in which the mounting arrangement for the brackets accommodates diverse conditions (such as nonsquare casings, irregular mounting surfaces and jumped casings) and compensates for initial misalignment of a bracket may be further understood by reference to FIGS. 12–14B. As shown in FIG. 12, the elongation of the slot 44 of each bracket 26 enables the bracket to move (relative to a subjacent casing 16 and to a fastening screw 54 fixed in the casing) toward and away from the adjacent window, i.e. in directions parallel to the long dimensions of the bracket seats. The spring 56, resiliently biasing the bracket base portion against the subjacent casing or other supporting surface, holds the bracket stably in position yet permits it to move (relative to the casing), in translation as shown in FIG. 12, and also pivotally about the axis of the screw 54 as shown in FIG. 13 (regardless of where in slot 44 the screw is located) to correct initial angular misalignment or to compensate for a nonsquare casing. It will be appreciated that when a case molding member is snap-fitted onto a bracket 26, the simultaneous engagement of the case molding member flanges with the two seat portions of the bracket automatically align the bracket with the case molding member so that the long dimensions of the bracket seat portions are perpendicular to the long dimension of the case molding member; hence, when a case molding member, or plural case molding members overlappingly interengaged endwise, are snap-fitted onto two or more brackets, the brackets automatically become properly aligned with each other, such self-aligning movement of the brackets being permitted by the slot and resilient-bias (spring) mounting arrangement.

A further mode of self-aligning or adjusting motion of the brackets, again permitted by the above-described mounting features, is illustrated in FIGS. 14A and 14B as exemplified by the jumped casing installation of FIG. 11. When a bracket 26 is initially mounted over the jumped casing, the biasing action of the spring 56 forces the base portion of the bracket to lie flat against the surface of a subjacent panel 12; since the panel surfaces lie in planes oriented obliquely to the vertical, the bracket seat portions 46a and 46b are then (as shown in FIG. 14A) not properly positioned for simultaneous engagement by the flanges of a vertically oriented case molding member. However, as seen in FIG. 14B, the upper portion of the bracket 26 is movable away from the subjacent panel surface (against the force of the biasing spring 56) to enable such simultaneous engagement of the seat portions by the flanges of a vertically oriented case molding member 20c, and the bracket is thereafter retained in the FIG. 14B position by those flanges. Other irregularities of the mounting surfaces may similarly be accommodated by outward movement of the bracket against the force of the spring 56.

With the present casing cover system, it is found that only a small number of different kits—differing from each other only with respect to the length of the components—are needed to accommodate a wide range of window sizes. An example of a series of such kits is set forth in the following table:

| | Kit 1 | Kit 2 | Kit 3 |
|---|---|---|---|
| Nominal window size (inches) | 38 × 40 | 44 × 56 | 52 × 80 |
| Side case molding members (length of each, inches) | 22 | 30 | 42 |
| Top case molding members (length of each, inches) | 21 | 24 | 28 |
| Lower side angle members (length of each, inches) | 25 | 34 | 54 |
| Upper side and top angle members (length of each, inches) | 16 | 23 | 27 |
| Sill covers (length of each, inches) | 28 | 31 | 35 |

Each kit includes four side case molding members, two top case molding members, two sill covers, two lower side angle members, four upper side and top angle members, and nine mounting brackets each having a mounting screw and spring.

It is to be understood that the invention is not limited to the features and embodiments hereinabove specifically set forth, but may be carried out in other ways without departure from its spirit.

We claim:

1. A window casing cover kit capable of being assembled on and in covering relation to a window casing at least partially surrounding a window opening, said cover kit comprising:

(a) a plurality of case molding members for covering said window casing, each of said members being an elongated resiliently deformable channel section having opposed longitudinal flanges bent toward each other and being adapted to be disposed immediately outwardly of a portion of said casing adjacent an edge of the window opening with the long dimension of the channel section oriented parallel to said edge and with the channel of the channel section opening inwardly, said members being further adapted to be thus disposed one after another around said opening in endwise engagement with each other thereby to cover said casing;

(b) a plurality of brackets for securing said members to said window casing, each of said brackets comprising a base portion adapted to be mounted on a portion of said casing and a pair of spaced, parallel, generally C-shaped seat portions adapted to be positioned on the outer side of said base with both seat portions extending transversely of the long dimension of one of said members and adapted to be simultaneously gripped between the opposed flanges of said one member, when said base is mounted on a portion of said casing and said one member is disposed immediately outwardly thereof as aforesaid, said seat portions being dimensioned for snap-on engagement of said member flanges with said seat portions, said brackets being further adapted to be mounted as aforesaid in spaced relation to each other on said casing around said window opening inwardly of said case molding members such that said case molding members are held on said casing by gripping engagement of their flanges with the seat portions of said brackets; and (c) for each of said brackets, fastening means adapted to be positioned in engaging relation to the bracket and to a portion of the casing for securing the base portion of the bracket to a portion of the casing when the base portion is mounted on the casing portion as aforesaid, and being further adapted, when thus positioned, to permit self-aligning translational, rotational, and in-and-out movement of the bracket relative to the last-mentioned casing portion upon engagement of the flanges of a case molding member with the bracket seat portions as aforesaid when the bracket base portion is mounted on the last-mentioned casing portion.

2. A cover kit as defined in claim 1, wherein said fastening means includes in the base portion of each said bracket an elongated slot extending generally parallel to said seat portions, and wherein said fastening means for each bracket further comprises (i) a fastening element having a head and a shank extending therefrom, and adapted to be positioned with said head spaced outwardly from the base portion of the bracket with which it is associated and said shank projecting inwardly from the head through the slot of the last-mentioned base portion into a subjacent portion of said casing when said base portion is mounted as aforesaid on said last-mentioned casing portion, and (ii) means adapted to be positioned between the fastening element head and the last-mentioned base portion, when the fastening element is positioned as aforesaid, for acting therebetween to resiliently bias the base portion against the subjacent casing portion.

3. A cover kit as defined in claim 2, wherein said biasing means comprises a helical spring adapted to surround the fastening element shank under compression between the head and the base portion when the fastening element is positioned as aforesaid.

4. A cover kit as defined in claim 1, wherein each of said members has a web with an outwardly offset portion along one side thereof, the flange of each said member adjacent the outwardly offset portion of the web thereof being wider than the other of the pair of flanges of the member; wherein said fastening means includes in the base portion of each of said brackets an elongated slot extending generally parallel to the seat portions of the bracket; wherein each of the seat portions of each of said brackets projects from the base portion of the bracket for a distance less than the width of the wider of said pair of flanges; wherein each of said brackets has a leg portion disposed to project outwardly from the base portion of the bracket, when the bracket base portion is mounted on a portion of the casing as aforesaid and one of said members is disposed immediately outwardly of the bracket as aforesaid, into engagement with the inner surface of the outwardly offset web portion of said one last-mentioned member so as to restrain said one last-mentioned member against inward displacement relative to the bracket; and wherein said fastening means for each bracket further comprises a fastening element adapted to extend through the slot of the base portion of its associated bracket into a subjacent portion of the casing when the base portion is mounted on the last-mentioned casing portion as aforesaid, and means, adapted to be positioned between the fastening element and the last-mentioned base portion, when the fastening element extends through the base portion slot as aforesaid, for acting therebetween to resiliently bias the base portion into engagement with the subjacent casing portion.

5. A cover kit as defined in claim 4, wherein each of said seat portions of each of said brackets is dimensioned and adapted to project outwardly from the base portion for a distance at least substantially equal to the width of the narrower of said flanges of said one member when the bracket base portion is mounted on a casing portion and said one member is disposed immediately outwardly thereof as aforesaid, such that each seat portion then engages a non-offset portion of the web of said one member for cooperating with said leg portion in restraining said one member against inward displacement, said leg portion being disposed between said pair of seat portions.

6. A cover kit as defined in claim 5, wherein each of said fastening elements comprises a headed screw adapted to be mounted through the base portion slot of the associated bracket into the subjacent casing portion and wherein each of said biasing means comprises a helical spring, adapted to surround the screw and to be compressed between the screw head and the bracket base portion when the screw is inserted as aforesaid, for urging the base portion against the subjacent casing portion.

7. A cover kit as defined in claim 6 capable of being assembled on a rectangular window casing having a top and sides, wherein said plurality of case molding members includes a first pair of said case molding members adapted to cover the casing top and second and third pairs of said case molding members respectively adapted to cover the two sides of the casing, one of each of said pairs of members being adapted to overlap the other member of the pair of endwise engagement therewith such that the combined length of the pair when assembled can be varied to conform to the dimensions of the window.

8. A cover kit as defined in claim 7, wherein opposite corners of said first pair of case molding members are cut at an oblique angle and are adapted to overlap the upper ones of said second and third pairs of members respectively to provide the appearance of mitered corners, and wherein said opposite corners further have laterally projecting tabs respectively adapted to fold over said upper ones of said second and third pairs of members, when said members cover said casing as aforesaid.

9. A cover kit as defined in claim 8, capable of being assembled on a rectangular window casing having sides, a top, and a sill, and further including angle members adapted to be mounted along the edges of the sides and top of said window casing inwardly of said case molding members, and a pair of sill covers respectively shaped to fit over left and right portions of the sill with one of said sill covers overlapping the other, and the inner portion of each of said sill covers having plural score lines to facilitate cutting of the sill cover to conform to the configuration of the sill on which it is mounted.

10. A cover kit as defined in claim 9, wherein each of said case molding members, angle members and sill covers is formed of sheet metal.

11. A cover kit as defined in claim 10, wherein each of said brackets is a unitary metal element formed by cutting and bending a flat metal plate.

12. A window casing cover mounted on and in covering relation to a window casing at least partially surrounding a window opening, said cover comprising:

(a) a plurality of case molding members for covering said window casing, each of said members being an elongated resiliently deformable channel section having opposed longitudinal flanges bent toward each other and being disposed immediately outwardly of a portion of said casing adjacent an edge of the window opening with the long dimension of the channel section oriented parallel to said edge and with the channel of said channel section opening inwardly, said members being disposed one after another around said opening in endwise engagement with each other thereby to cover said casing;

(b) a plurality of brackets spaced around said casing for securing said members to said casing, each of said brackets comprising a base portion mounted on a portion of said casing directly inwardly of one of said members and a pair of spaced, parallel, generally C-shaped seat portions projecting outwardly from said base into the channel of said one member with both seat portions extending transversely of the long dimension of said one member and simultaneously gripped between the opposed flanges of said one member for holding said one member in covering relation to the casing, said seat portions being dimensioned for snap-on engagement of said member flanges with said seat portions; and (c) for each of said brackets, fastening means engaging the bracket and a portion of the casing subjacent thereto for securing the bracket to said last-mentioned casing portion while permitting self-aligning translational, rotational and in-and-out movement of the bracket relative to the last-mentioned casing portion upon engagement of the flanges of a case molding member with the bracket seat portions with the bracket secured to the last-mentioned casing portion.

13. A cover as defined in claim 12, wherein said fastening means includes in the base portion of each said bracket an elongated slot extending generally parallel to said seat portions, and wherein said fastening means for each bracket further comprises (i) a fastening element having a head disposed in outwardly spaced relation to the base portion of the bracket with which it is associated, and a shank extending inwardly from the head through the slot of the last-mentioned base portion into a portion of the casing subjacent thereto, and (ii) means acting between the fastening element head and the last-mentioned base portion for resiliently biasing the base portion against the subjacent casing portion.

14. A cover as defined in claim 13, wherein said biasing means of each of said fastening means comprises a helical spring surrounding the fastening element shank under compression between the head and the base portion.

15. A cover as defined in claim 13, wherein each of said members has a web with an outwardly offset portion along one side thereof, the flange of each said member adjacent the outwardly offset portion of the web thereof being wider than the other of the pair of flanges of the member; wherein the seat portions of each of said brackets project outwardly from said base portion for a distance less than the width of the wider of said pair of flanges; and wherein each of said brackets further has a leg portion projecting outwardly from said base portion for engaging the outwardly offset web portion of the member gripping the bracket seat portions to restrain said last-mentioned member against inward displacement relative to the bracket.

16. A cover as defined in claim 15, wherein each of said seat portions of each of said brackets projects outwardly from the base portion for a distance at least substantially equal to the width of the narrower of said flanges of the member gripping said seat portions such that each seat portion engages a non-offset portion of the web of the last-mentioned member for cooperating with said leg portion in restraining the last-mentioned member against inward displacement, said leg portion being disposed between said pair of seat portions.

17. A cover as defined in claim 15, wherein each of said fastening elements comprises a headed screw inserted through the base portion slot of the associated bracket into a portion of the casing subjacent thereto and wherein each of said biasing means comprises a helical spring, surrounding the screw and compressed between the screw head and the bracket base portion, for urging the base portion against the subjacent casing portion.

18. A cover as defined in claim 13, mounted on a rectangular window casing having a top and sides, and including a first pair of said case molding members for covering said top and second and third pairs of said case molding members for respectively covering the two sides of the casing, one of each of said pairs of members overlapping the other member of the pair in endwise engagement therewith such that the combined length of the assembled pair can be varied.

19. A cover as defined in claim 18, wherein opposite corners of said first pair of case molding members are cut at an oblique angle for overlapping the upper ones of said second and third pairs of members, respectively, to provide the appearance of mitered corners; and wherein said opposite corners further have laterally projecting tabs respectively folded over said upper ones of said second and third pairs of members.

20. A trim system kit capable of being assembled on a surface of a supporting structure, said kit comprising:

(a) at least one trim member, comprising at least one elongated resiliently deformable channel section having opposed longitudinal flanges bent toward each other and adapted to be disposed immediately outwardly of said surface with the channel of the channel section opening inwardly toward said surface;

(b) at least two brackets for securing said member to said surface, said brackets being adapted to be mounted on said surface in spaced relation to each other and to be disposed between said one member and said surface when said one member is disposed immediately outwardly of said surface as aforesaid, each of said brackets comprising a base portion adapted to overlie said surface and a pair of spaced, parallel, generally C-shaped seat portions adapted to be positioned on the outer side of said base with both seat portions extending transversely of the long dimension of said one member and adapted to be simultaneously gripped between the opposed flanges of said one member, when the bracket is mounted on said surface and said one member is disposed immediately outwardly thereof as aforesaid, said seat portions being dimensioned for snap-on engagement of said member flanges with said seat portions such that said one member is held on said surface by gripping engagement of its flanges with the seat portions of said brackets; and (c) for each of said brackets, fastening means adapted to be positioned in engaging relation to the bracket and to said structure for securing the bracket to said structure when the bracket base portion overlies said surface as aforesaid, and being further adapted, when thus positioned, to permit self-aligning translational, rotational, and in-and-out movement of the bracket relative to said surface upon engagement of the flanges of said one member with the bracket seat portions as aforesaid when the bracket is secured to said structure.

21. A trim system kit as defined in claim 20, wherein said fastening means includes in the base portion of each said bracket an elongated slot extending generally parallel to said seat portions, and wherein said fastening means for each bracket further comprises (i) a fastening element having a head and a shank extending therefrom, and adapted to be positioned with said head spaced outwardly from the base portion of the bracket with which it is associated and said shank projecting inwardly from the head through the slot of the last-mentioned base portion into said supporting structure when said bracket is mounted on said surface as aforesaid, and (ii) means adapted to be positioned between the fastening element head and the last-mentioned base portion, when the fastening element is positioned as aforesaid, for acting therebetween to resiliently bias the base portion against said surface.

22. A trim system kit as defined in claim 21, wherein said biasing means comprises a helical spring adapted to surround the fastening element shank under compression between the head and the base portion when the fastening element is positioned as aforesaid.

23. A trim system kit as defined in claim 20, wherein said one trim member comprises at least two of said channel sections, one of which is adapted to overlap the other in endwise engagement therewith to constitute an effectively unitary member when said one trim member is secured to said surface by said brackets.

24. A trim system mounted on a surface of a supporting structure, said system comprising:

(a) at least one trim member, comprising at least one elongated resiliently deformable channel section having opposed longitudinal flanges bent toward each other, and disposed immediately outwardly of said surface with the channel of said channel section opening inwardly;

(b) at least two brackets mounted on said surface inwardly of said one member in spaced relation to each other for securing said one member to said surface, each of said brackets comprising a base portion overlying said surface directly inwardly of said one member and a pair of spaced, parallel, generally C-shaped seat portions projecting outwardly from said base into the channel of said one member with both seat portions extending transversely of the long dimension of said one member and simultaneously gripped between the opposed flanges of said one member for holding said one member on the surface, said seat portions being dimensioned for snap-on engagement of said member flanges with said seat portions; and (c) for each of said brackets, fastening means engaging the bracket and the supporting structure subjacent thereto for securing the bracket to the supporting structure while permitting selfaligning translational, rotational and in-and-out movement of the bracket relative to said surface upon engagement of the flanges of said one member with the bracket seat portions.

* * * * *

UNITED STATES PATENT AND TRADEMARK OFFICE

CERTIFICATE OF CORRECTION

PATENT NO. : 4, 193,238

DATED : March 18, 1980

INVENTOR(S) : Alexander A. Chalmers et al.

It is certified that error appears in the above-identified patent and that said Letters Patent are hereby corrected as shown below:

Col. 1, line 67, "windown" should read --window-- .

Col. 2, line 45, "slot and" should read --slot with-- .

Col. 3, line 24, "origentation" should read --orientation-- .

Col. 4, line 31, "top" should read --two-- ;

line 34, before "true" delete "the" .

Col. 6, line 2, "these" should read --case-- .

Signed and Sealed this

Sixteenth Day of November 1982

[SEAL]

*Attest:*

GERALD J MOSSINGHOFF

*Attesting Officer*

*Commissioner of Patents and Trademarks*